United States Patent [19]

Williamson et al.

[11] 4,109,725

[45] Aug. 29, 1978

[54] SELF ADJUSTING LIQUID SPRING OPERATING APPARATUS AND METHOD FOR USE IN AN OIL WELL VALVE

[75] Inventors: Jim R. Williamson, Carrollton, Tex.; Floyd A. Gonzalez, Duncan, Okla.

[73] Assignee: Halliburton Company, Duncan, Okla.

[21] Appl. No.: 846,076

[22] Filed: Oct. 27, 1977

[51] Int. Cl.[2] ..... E21B 43/12

[52] U.S. Cl. ..... 166/315; 166/321; 137/DIG. 7; 251/62

[58] Field of Search ..... 166/264, 314, 315, 319, 166/321; 251/62, 63, 63.4, 63.5, 63.6; 137/DIG. 7

[56] References Cited

U.S. PATENT DOCUMENTS

| | | | |
|---|---|---|---|
| 3,431,985 | 3/1969 | Bowen | 173/119 |
| 3,786,865 | 1/1974 | Tausch et al. | 166/323 |
| 3,786,866 | 1/1974 | Tausch et al. | 166/323 |
| 3,823,773 | 7/1974 | Nutter | 166/0.5 |
| 3,842,913 | 10/1974 | Mott | 166/314 |
| 3,850,250 | 11/1974 | Holden et al. | 166/315 |
| 3,856,085 | 12/1974 | Holden et al. | 166/264 |
| 3,870,104 | 3/1975 | Mott | 166/208 |
| 3,915,228 | 10/1975 | Giebeler | 166/321 |
| 3,930,540 | 1/1976 | Holden et al. | 166/315 |

*Primary Examiner*—James A. Leppink
*Attorney, Agent, or Firm*—Floyd A. Gonzalez; John H. Tregoning

[57] ABSTRACT

Disclosed is an apparatus and its method of operation for an oil well valve having a self adjusting liquid spring responsive to changes in pressure in the well annulus. The valve has a liquid spring contained in a spring chamber divided by a piston means which moves responsive to annulus pressure changes to operate the valve. The piston means includes a metering means to meter liquid from one side of the piston to the other as the volume of the liquid changes due to pressure and temperature changes. The piston means moves responsive to pressure changes in the well annulus which pressure changes are applied to the well annulus at a rate faster than the metering means may relieve the changes. A mechanical spring means in conjunction with the metering means returns the piston means to its original position after a predetermined time. Bypass means is additionally disclosed which bypasses the metering means and may be arranged such that piston means movement occurs on either pressure increases or pressure decreases in the well annulus.

8 Claims, 8 Drawing Figures

Figure 1:
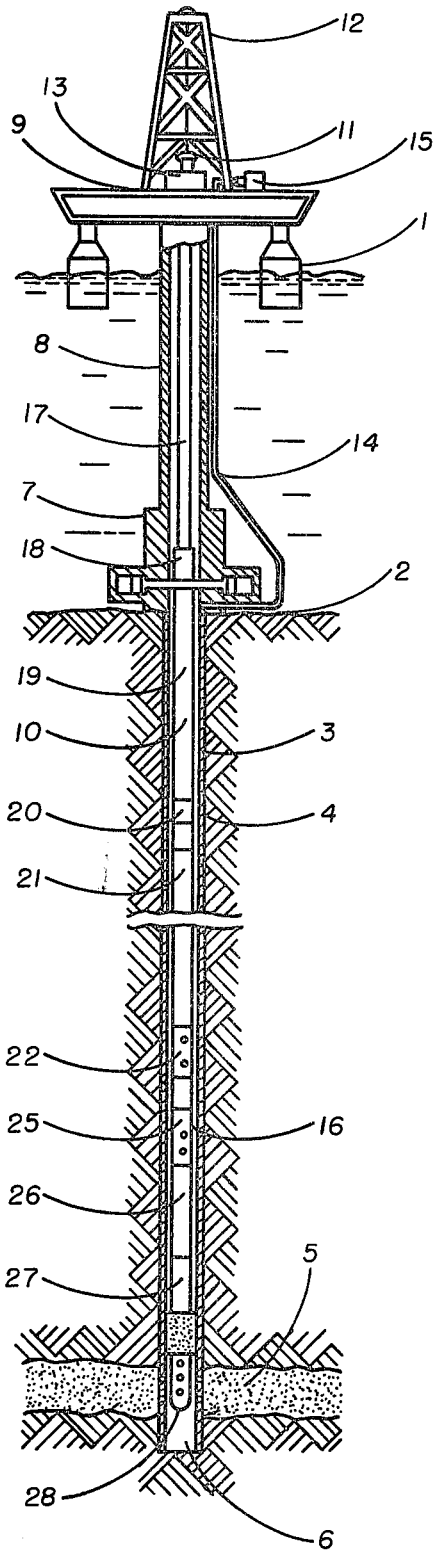

SELF ADJUSTING LIQUID SPRING OPERATING APPARATUS AND METHOD FOR USE IN AN OIL WELL VALVE

BACKGROUND OF THE INVENTION

This invention relates to a valve for providing fluid communication between the interior of a tubing string in an oil well and the well annulus surrounding the tubing string. More particularly, the apparatus relates to a circulation valve for use in a testing program for a submerged oil well.

Circulation valves are known for use in a testing program in an oil well wherein the circulation valve opens after a predetermined number of incremental movements. These incremental movements are caused by an increase in annulus pressure wherein the annulus pressure is exerted against a piston to compress an inert gas in the apparatus for supplying a return spring force. Such a circulation valve is disclosed in U.S. Pat. No. 3,850,250 issued Nov. 26, 1974 to Holden et al and assigned to the assignee of the present invention.

Other valves for use in an oil well are known wherein the valves are operated by changing the pressure differential between the pressure in the annulus of the well and that pressure present in a flow channel in the interior of the tubing string.

The use of compressible liquid to provide spring force for use in industrial applications is also known.

A production valve shiftable from one producing formation to another by application of operating pressure changes in the annulus of an oil well is also known as disclosed in U.S. Pat. No. 2,951,536 to Garrett issued Sept. 6, 1960. The valve disclosed therein includes a chamber precharged with gas and a piston dividing the chamber having a metering orifice through said piston wherein pressure increases are metered through said orifice at a predetermined rate to provide a resulting pressure differential between a section of the pressure chamber on one side of the piston from a section of the pressure chamber on the other side of said piston. This pressure differential between chamber sections causes the apparatus to shift from a first position to a second position.

The use of a compressible liquid such as silicon oil, and a mechanical ratchet apparatus for providing for changes in the volume of the compressible liquid as the apparatus is lowered into the well bore is disclosed in a U.S. Patent application to Barrington filed on an even date with the present application and assigned to the assignee of the present invention.

Disclosed is an oil well apparatus for moving a valve in the well bore from a closed position to an open position responsive to sudden changes in the pressure in the well annulus. The apparatus includes a piston arrangement which, when moved a sufficient distance in one longitudinal direction, allows the mentioned valve to be opened.

The piston includes means to balance relatively gradual pressure changes in the well annulus without moving the piston arrangement. Sudden pressure changes in the well annulus will cause an incremental movement of the piston arrangement toward the open position. However, if the sudden pressure change is not followed within a predetermined time with another sudden pressure change, the piston arrangement contains means to return the piston arrangement back to its initial position. It will thus be understood that the piston arrangement is incrementally moved from a position where the valve is closed to a position where the valve is allowed to open by a series of sudden pressure changes where, if the series is interrupted for a sufficient period of time, the piston arrangement will return to its original position.

A piston means is provided having a volume of silicon oil trapped on one side, and subject on a second side to well annulus pressure. Increases in well annulus pressure moves the piston means to compress the silicon oil. A flow metering means is provided in the piston means to allow silicon oil to flow past a piston in the piston means without moving the piston means, thereby allowing for relatively gradual volume changes of the silicon oil as caused by the changing pressure and temperature of the silicon oil as the apparatus is lowered into a well bore.

A spring means is also provided in the piston means for moving the piston means back toward its initial position over a period of time by working in conjunction with the metering means to meter silicon oil flow through the metering means.

A check valve means is also provided for allowing access to the trapped volume of silicon oil at a predetermined point in the well annulus pressure change. In one embodiment, the check valve means is closed when the well annulus pressure is increased, and opens to allow silicon oil out of the trapped volume when a well annulus pressure increase is suddenly released such that the incremental movement occurs in the piston means during pressure increases. In another embodiment, the check valve means opens during a pressure increase to let silicon oil into the trapped volume, and closes during a sudden pressure decrease such that the incremental movement in the piston means occurs when the well annulus pressure is released.

A spring loaded holding means is disclosed to hold the valve in its closed position until the piston means moves a predetermined distance in one longitudinal direction, and then to release for allowing a spring to move the valve to its open position.

The valve disclosed is a well testing circulation valve which is maintained in the closed position during a well testing program, and then opened to allow circulation between the well annulus and the interior of a testing string after a series of well annulus pressure changes within a predetermined time.

THE DRAWINGS

A brief description of the appended drawings follows:

FIG. 1 provides a schematic "vertically sectioned" view of a representative offshore installation which may be employed for formation testing purposes and illustrates a formation testing "string" or tool assembly in position in a submerged well bore and extending upwardly to a floating operation and testing station.

Figure 2:
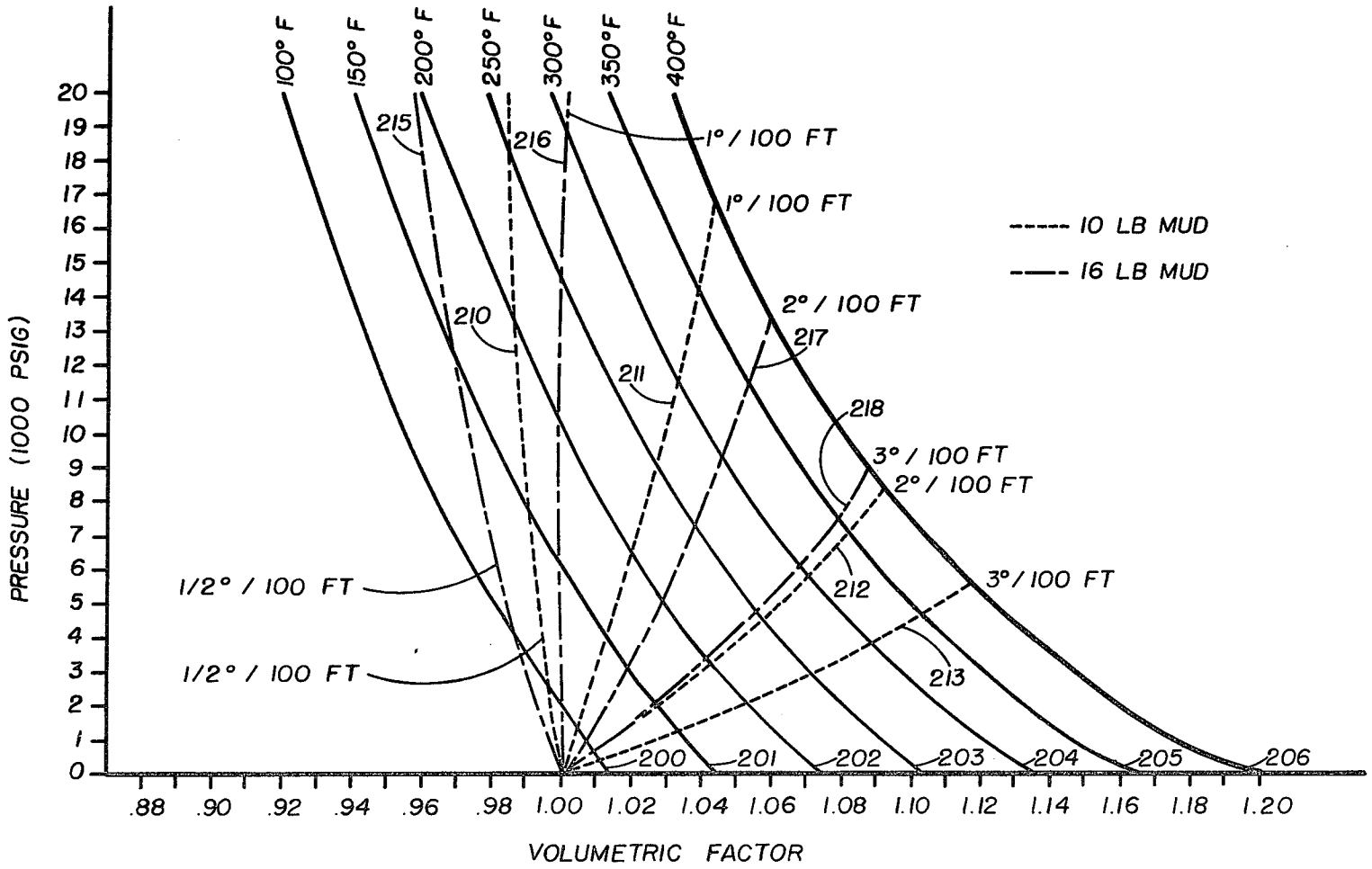

FIG. 2 provides a chart showing the volumetric factor of 20 centistoke silicon oil along the horizontal axis, and pressure in 1000 PSIG increments along the vertical axis. A family of curves shows the volume of silicon oil subjected to the temperatures and pressures indicated. Lines are also provided showing the volume of silicon oil at various pressures and temperatures experienced by silicon oil in a well bore having specified temperature gradients and containing the indicated drilling mud weights.

Figure 3A:
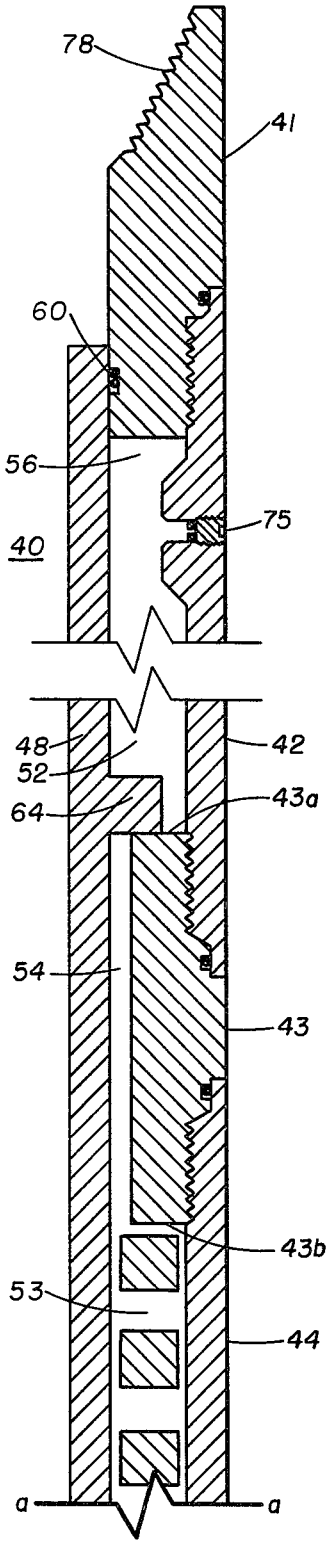
Figure 3B:
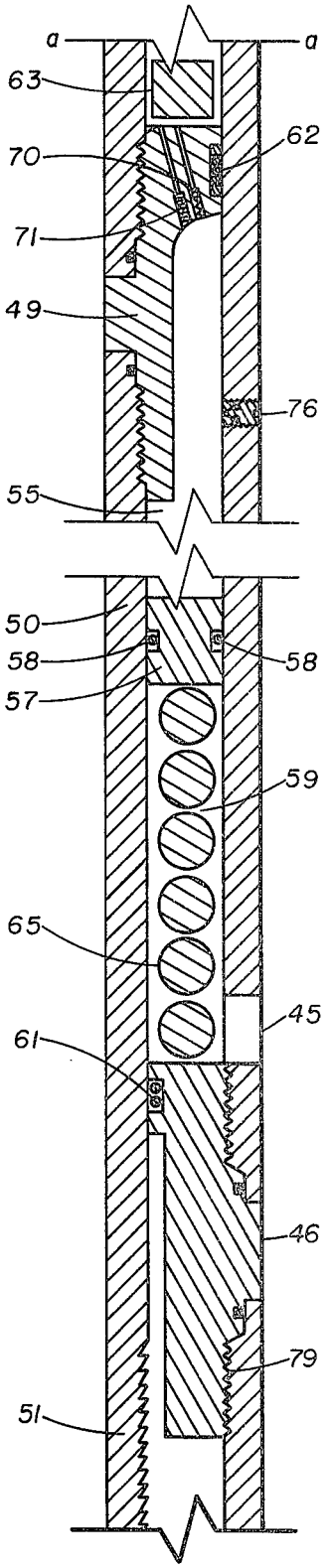

FIGS. 3*a*–3*b* joined along section line *a*—*a* illustrate a vertically sectioned, right side only view of one embodiment of the power section of the apparatus wherein the piston means is moved to the open position responsive to sudden increases in well annulus pressure.

FIGS. 4*a*–4*d* joined along section lines *a*—*a* through *c*—*c* illustrate a second embodiment of the apparatus having a power section and a circulation valve section wherein the piston means moves toward the open position responsive to sudden decreases in well annulus pressure.

OVERALL WELL TESTING ENVIRONMENT

During the course of drilling an oil well, the borehole is filled with a fluid known as drilling fluid or drilling mud. One of the purposes of this drilling fluid is to contain in intersected formations any fluid which may be found there. To contain these formation fluids the drilling mud is weighted with various additives so that the hydrostatic pressure of the mud at the formation depth is sufficient to maintain the formation fluid within the formation without allowing it to escape into the borehole.

When it is desired to test the production capabilities of the formation, a testing string is lowered into the borehole to the formation depth and the formation fluid is allowed to flow into the string in a controlled testing program. Lower pressure is maintained in the interior of the testing string as it is lowered into the borehole. This is usually done by keeping a valve in the closed position near the lower end of the testing string. When the testing depth is reached, a packer is set to seal the borehole thus closing in the formation from a hydrostatic pressure of the drilling fluid in the well annulus.

The valve at the lower end of the testing string is then opened and the formation fluid, free from the restraining pressure of the drilling fluid, can flow into the interior of the testing string.

The testing program includes periods of formation flow and periods when the formation is closed-in. Pressure recordings are taken throughout the program for later analysis to determine the production capability of the formation. If desired, a sample of the formation fluid may be caught in a suitable sample chamber.

At the end of the testing program, a circulation valve in the test string is opened, formation fluid in the testing string is circulated out, the packer is released, and the testing string is withdrawn.

The annulus pressure operated method of opening and closing the tester valve, as disclosed in U.S. Pat. No. 3,664,415 issued May 23, 1972 to Wray et al and U.S. Pat. No. 3,856,085 issued Dec. 24, 1974 to Holden et al, is particularly advantageous in offshore locations where it is desirable to the maximum extent possible, for safety and environmental protection reasons, to keep the blowout preventers closed during the major portion of the testing procedure.

The total number of pressure applications of the testing program can be counted and the tool of the present application is then designed so that each pressure application will incrementally move the apparatus one step toward the opened condition. The disclosed circulation valve will thus not open until the testing program is complete. This concept is also disclosed in U.S. Pat. No. 3,850,250 issued Nov. 26, 1974 to Holden et al and assigned to the assignee of the present invention.

A typical arrangement for conducting a drill stem test offshore is shown in FIG. 1. Such an arrangement would include a floating work station 1 stationed over a submerged work site 2. The well comprises a well bore 3 typically lined with a casing string 4 extending from the work site 2 to a submerged formation 5. The casing string 4 includes a plurality of perforations at its lower end which provide communication between the formation 5 and the interior of the well bore 6.

At the submerged well site is located the well head installation 7 which includes blowout preventer mechanisms. A marine conductor 8 extends from the well head installation to the floating work station 1. The floating work station includes a work deck 9 which supports a derrick 12. The derrick 12 supports a hoisting means 11. A well head closure 13 is provided at the upper end of marine conductor 8. The well head closure 13 allows for lowering into the marine conductor and into the well bore 3 a formation testing string 10 which is raised and lowered into the well by hoisting means 11.

A supply conduit 14 is provided which extends from a hydraulic pump 15 on the deck 9 of the floating station 1 and extends to the well head installation 7 at a point below the blowout preventers to allow the pressurizing of the well annulus 16 surrounding the test string 10.

The testing string includes an upper conduit string portion 17 extending from the work site 1 to the well head installation 7. A hydraulically operated conduit string test tree 18 is located at the end of the upper conduit string 17 and is landed in the well head installation 7 to thus support the lower portion of the formation testing string. The lower portion of the formation testing string extends from the test tree 18 to the formation 5. A packer mechanism 27 isolates the formation 5 from fluids in the well annulus 16. A perforated tail piece 28 is provided at the lower end of the testing string 10 to allow fluid communication between the formation 5 and the interior of the tubular formation testing string 10.

The lower portion of the formation testing string 10 further includes intermediate conduit portion 19 and torque transmitting pressure and volume balanced slip joint means 20. An intermediate conduit portion 21 is provided for imparting packer setting weight to the packer mechanism 27 at the lower end of the string.

A circulation valve 22 of the present invention is located near the end of the testing string 10 as shown. Also near the lower end of the formation testing string 10 below the circulation valve 22 is located a tester valve 25 which is preferably the tester valve disclosed in U.S. Pat. No. 3,856,085. As will be discussed later, each pressure application in the well annulus 16 will open the tester 25 and will move the circulation valve 22 an incremental step toward opening.

Circulation valve 22 can be designed to require a few more increments to open than the testing program requires. At the end of the program a higher pressure is applied to the annulus 16 to close and lock the tester valve 25 as is disclosed in U.S. Pat. No. 3,856,085. Additional pressure applications can then be applied to annulus 16 to open the circulation valve 22 disclosed herein.

A pressure recording device 26 is located below the tester valve 25. The pressure recording device 26 is preferably one which provides a full opening passageway through the center of the pressure recorder to provide a full opening passageway through the entire length of the formation testing string.

It may be desirable to add additional formation testing apparatus in the testing string 10. For instance, where it is feared that the testing string 10 may become stuck in the borehole 3 it is desirable to add a jar mechanism between the pressure recorder 26 and the packer assembly 27. The jar mechanism is used to impart blows to the testing string to assist in jarring a stuck testing string loose from the borehole in the event that the testing string should become stuck. Additionally, it may be desirable to add a safety joint between the jar and the packer mechanism 27. Such a safety joint would allow for the testing string 10 to be disconnected from the packer assembly 27 in the event that the jarring mechanism was unable to free a stuck formation testing string.

The location of the pressure recorder device may be varied as desired. For instance, the pressure recorder may be located below the perforated tail piece 28 in a suitable pressure recorder anchor shoe running case. In addition, a second pressure recorder may be run immediately above the tester valve 25 to provide further data to assist in evaluating the well.

FIG. 2 gives the relationship between the volume of silicon oil to the pressure and temperature of the oil. The graph of FIG. 2 is for silicon oil having a kinetic viscosity of 20 centistokes. As can be seen from FIG. 2, the abscissa shows the volumetric factor of the silicon oil while the ordinate shows the pressure in thousandths of PSIG exerted on the oil. The family of curves 200 through 206 shows the volume of the silicon oil at various constant temperatures.

Also shown on the chart of FIG. 2 are curves 210 through 213 showing the absolute volume of 20 centistoke silicon oil for boreholes having various temperature gradients and filled with 10 pounds per gallon drilling mud. Likewise, curves 215 through 218 show curves for boreholes having various temperature gradients and filled with 16 pounds per gallon drilling mud.

It can be seen that 20 centistoke silicon oil expands as the pressure and temperature increases with depth in a well bore as a tool containing the silicon oil is lowered in a well bore having a temperature gradient of 1° per 100 feet or higher. This is true for the lighter drilling muds as shown by line number 211 for 10 pounds per gallon mud and also for heavier drilling mud as shown by the line 216 for 16 pounds per gallon mud.

FIG. 2 was developed from theoretical values of the bulk moduli of 20 centistoke silicon oil having an initial pressure and temperature of 0 PSIG and 77° F., respectively, from the paper, "A Correlation of Bulk Moduli and P-V-T Data for Silicon Fluids at Pressures up to 500,000 PSIG" by John A. Tichy and Ward O. Winer, ASLE Transactions 11, 333–334 (1968). These values for lines 200, 201 and 202 were verified by experimental data up to about 11,000 PSIG. Lines 210 through 213 and lines 215 through 218 were plotted using the theoretical bulk moduli of 20 centistoke silicon oil for the various temperature gradients indicated. Ten pounds per gallon mud was chosen as approximately the lightest drilling fluid used in the industry and 16 pounds per gallon mud was chosen as approximately the heaviest drilling fluid presently used.

PREFERRED EMBODIMENTS

FIGS. 3*a* and 3*b* disclose a preferred embodiment of a power section of the present invention. This apparatus may be used as a power section for a circulation valve 22 such as that disclosed in U.S. Pat. No. 3,850,250 issued Nov. 26, 1974 to John Holden et al and assigned to the assignee of the present invention. This apparatus may also be the power section of similar circulation valves such as that disclosed in the patent application to Quinton Barrington filed on the same date as the present application and owned by the assignee of the present invention.

The power apparatus shown in FIGS. 3*a* and 3*b* has a central bore 40 which communicates with the flow passage of the testing string 10 above and below the apparatus. The power apparatus includes an outer tubular housing made up of a housing adapter 41, a power chamber housing 42, an intermediate housing 43, a piston chamber housing 44 having power port 45, and a lower housing adapter 46.

Slidably and axially located in the interior bore 40 of the tubular housing assembly is a power mandrel assembly having an upper power mandrel 48, a power piston 49, a lower power mandrel housing 50 which includes a toothed portion 51 of the lower power mandrel portion 53. This lower toothed portion 51 may be used in combination with a circulation valve shown in FIG. 1*a* and FIG. 1*b* and disclosed in the aforementioned U.S. Pat. No. 3,850,250. In this case the toothed portion 51 of the present power mandrel would be substituted for the pull mandrel 5 shown in FIG. 1*b* of that patent.

An upper silicon oil chamber 52 is provided between the power mandrel portion 48 and the power chamber housing 42 as shown in FIG. 3*a*. A spring chamber 53 is provided in the silicon oil chamber 52 between the power mandrel portion 48 and piston chamber housing 44 as shown in FIGS. 3*a* and 3*b*. An interconnecting silicon oil chamber 54 is provided to conduct silicon oil from the main oil chamber 52 to the spring chamber 53 as shown between the intermediate housing 43 and the power mandrel portion 48. Also provided on the lower side of power piston 49 is lower silicon oil chamber 55.

The upper end of main silicon oil chamber 52 is provided by a downward directed face 56 of the housing adapter 41 as shown in FIG. 3*a*. The lower end of the lower silicon oil chamber 55 is provided by a floating piston 57 which is sealed by seals 58. It can be seen that seals 58 prevent silicon oil trapped in the silicon oil chambers 52, 54, 53 and 55 from moving past the floating piston 57 and mingling with well annulus fluid. This annulus fluid, normally drilling mud, appears in a power chamber 59 which is a continuation of the lower silicon oil chamber 55. Power chamber 59 communicates with the annulus through power port 45 in the walls of piston chamber housing 44 described earlier.

Seals 61 are provided in the lower adapter 46 between the adapter 46 and lower power mandrel 50. Seals are also provided in the upper housing adapter 41 between the housing adapter and the upper power mandrel 48. These seals isolate the interior portion 40 of the power section from the silicon oil chambers and from the annulus fluid exterior of the power section.

Seals 62 in power piston 49 are provided to prevent silicon oil passage between the lower silicon oil chamber 55 and the main silicon oil chamber consisting of spring chamber 53, intermediate chamber 54 and silicon oil chamber 52. The exchange of silicon oil past the power piston 49 between these chambers is fully described later.

A square spring 63 is provided between a downwardly directed face 43*b* of intermediate housing section 43 and the power piston 49. This spring may be precompressed to overcome the seal friction of the power section and the operating friction which might be present in the circulation valve. This spring may also be designed to have limited travel to limit the amount of movement that the power mandrel 48 and its connected power piston 49 may make.

An outwardly directed shoulder 64 on power mandrel portion 48 is also provided which interconnects with upwardly directed face 43*a* of intermediate housing 43. It may be seen that the arrangements of intermediate housing 43 and the shoulder 64 and the square spring 63 with the power piston 49 are such that a positioning means is provided which maintains the power mandrel in a fixed relationship with the power section housing in the normal or at rest condition.

An optional spring 65 may be provided in the power chamber 59 to maintain the floating piston 57 in a fixed relationship when there is no movement in the power section.

A check valve 70 is provided in the power piston 49 and is arranged to allow free travel of silicon oil from the upper chamber 52 to the lower chamber 55. The check valve is designed to check or prevent fluid from traveling from the lower chamber 55 to the upper chamber 52.

Power piston 49 also contains a metering means 71 such as the Lee Visco jet device of patent application Ser. No. 792,655 filed May 2, 1977 by Randy Baker and owned by the assignee of the present invention.

It can thus be seen that as the tool is lowered into an oil well, an increasing annulus pressure is admitted by port 45 into power chamber 59. Changes in the volume of silicon oil in chamber 55 and chamber 52 caused by the pressure and temperature of the well annulus fluid moves floating piston 58. If a different pressure develops in chamber 52 from that present in chamber 55, fluid communication between chambers 52 and 55 is provided by passageway 54 and metering means 71.

When it is desired to move the inner power mandrel, fluid pressure in the annulus may be increased quickly. This quick increase in pressure is communicated to power piston 49 through floating piston 57 and the silicon oil in chamber 55. This sudden pressure increase causes check valve 70 to close and is quicker than may be relieved by metering means 71. Thus, such a quick annulus pressure increase will compress the fluid in chamber 52 and will cause the power piston to move in the upwardly direction also compressing spring means 63.

A sudden release in pressure will result in a lower pressure in chamber 55 and will thus open check valve 70 allowing silicon oil to move from chamber 55 through passageway 54 into chamber 55. A subsequent sudden pressure increase will again move power piston 49 in the upward direction further compressing spring 63. The total power stroke will be limited by the distance that square spring 63 may be compressed.

If no further pressure changes are exerted on the well annulus, the spring 63 biases power piston 49 in the downwardly or rightward direction and metering means 71 allows fluid to be metered from lower chamber 55 to upper chamber 52. Thus, after a predetermined length of time the power piston will return to its initial setting.

It can thus be seen that to operate a well testing apparatus such as a circulation valve described, that successive pressure changes exerted on the well annulus transfers silicon oil from chamber 52 to chamber 55 through check valve 70. If these pressure changes occur rapidly enough, silicon oil transferred through check valve 70 will not have time to be metered back into chamber 52 by metering means 71 between pressure changes, thereby moving piston 49 in a first upward direction. Long periods of time between pressure changes, such as is present during an oil well testing operation when the formulation 5 is in the closed-in condition, will cause power piston 49 to move in an opposite, downward direction by the action of metering means 71 and spring means 63 thereby moving the power mandrel apparatus downwardly until shoulder 64 is engaged with upward directed face 43*a* of intermediate housing section 43.

The oil well apparatus such as the circulation valve described may be designed to move a circulation valve from a closed position to an open position after a predetermined number of rapid pressure changes; or by a predetermined number of power strokes, each stroke requiring a predetermined number of pressure changes.

An upper oil plug 75 and a lower oil plug 76 are provided in the outer housing assembly to facilitate filling the chambers 52 and 55 with silicon oil. Threads 78 to connect the power section into the testing string above the power section and threads 79 to connect the power section into the circulation valve are also provided and shown in FIGS. 3*a* and 3*b*.

A second preferred embodiment is disclosed in FIGS. 4*a*–4*d*. The apparatus of the embodiment in FIGS. 4*a*–4*d* includes a central bore 80 throughout the apparatus. The apparatus includes an outer housing assembly having a top adapter housing 81, a power section housing 82 including a power port 83, an oil chamber housing section 84, an intermediate housing section 85, a circulation valve housing section 86, and a lower housing adapter 87 including a circulation port 88. Threads 89 in the lower housing adapter are provided for connecting the disclosed apparatus to the testing string below the apparatus; and threads 90 are provided to connect the upper housing adapter into a testing string above the apparatus.

The apparatus further includes an inner power mandrel assembly having a power mandrel 92, a power piston 93, a follower mandrel 95, a pull mandrel 96, and a pull ratchet mandrel 97.

At the lower end of the inner power mandrel is a pull ratchet assembly 200 comprising a plurality of windows 160 provided in pull ratchet mandrel 97 in which are located a corresponding number of ratchet blocks 98. Pins 161 are provided in ratchet blocks 98 and arranged such that the blocks 98 may not be pushed through the windows 160. Coil springs 162 are provided in appropriate slots around the ratchet blocks 98 and pull ratchet mandrel 97 to urge ratchet blocks 98 radially inwardly.

A holding ratchet assembly 201 comprises a holding ratchet mandrel 138 threadably connected to the outer housing assembly at the upper extension of intermediate housing 85. A plurality of windows 163 are provided in holding ratchet mandrel 138, and a corresponding number of ratchet blocks 139 appear in windows 163. Pins 164 in ratchet blocks 139 prevent the ratchet blocks 139 from being pushed inwardly through the windows 163. Coil springs 165 are provided in appropriate slots in holding ratchet mandrel 138 and ratchet blocks 139 to urge ratchet blocks 139 radially inwardly.

An operating mandrel 100 extends between pull ratchet assembly 200 and holding ratchet assembly 201. Ratchet teeth 140 on operating mandrel 100 cooperate with corresponding teeth in ratchet blocks 98 and 139. Teeth 140 are slanted on the upward facing side and squared on the downward facing side for allowing operating mandrel 100 to move in the upward direction but for preventing downward movement of operating mandrel 100.

Thus, when the power mandrel assembly moves upwardly, operating mandrel 100 will be pulled upwardly as pull ratchet assembly 200 locks and holding ratchet assembly 201 releases by the action of teeth 140. When the power mandrel assembly moves downwardly, holding ratchet assembly 201 locks or holds operating mandrel 100 while pull ratchet assembly 200 releases and moves downwardly with the power mandrel assembly to take another bite of operating mandrel 100. This arrangement assures that the operating mandrel 100 always moves upwardly during reciprocal operating strokes of the power mandrel assembly.

The interconnected chambers between the power mandrel assembly and the outer housing assembly are sealed from the inner bore 80 of the apparatus by seals 101 in the lower operating mandrel, seals 102 in the upper housing adapter, and the seals 104 between the pull mandrel 96 and the operating mandrel 100.

An annular power chamber 105 is provided between the power section housing 82 and the power mandrel 92. A floating piston 106 divides power chamber 105. Seals 107 are provided in floating piston 106 to give a fiuid tight seal between the upper portion of power chamber 105 and the lower portion of this power chamber which forms an upper silicon oil chamber 108.

An intermediate silicon oil chamber 109 is provided between the oil chamber housing section 84 and the follower mandrel 95 as shown. A main silicon oil chamber 110 is provided between the oil chamber housing section 84 and pull mandrel 96. A lower silicon oil chamber 111 is provided between intermediate housing section 85 and operating mandrel 100. All of these silicon oil chambers are interconnected such that silicon oil may be placed in these chambers and be isolated by appropriate seals from the inner bore 80 of the apparatus and the well annulus 16 of the well. A port 112 is provided in pull mandrel 96 to allow for free and unrestricted upward travel of operating mandrel 100 and to prevent a hydrostatic lockup.

Seals 103 are provided in power piston 93 to divide upper silicon oil chamber 108 from intermediate oil chamber 109. Seals 101 and 104 isolate pull ratchet assembly 200 and hold ratchet assembly 201 from the inner bore 80, and place these ratchet assemblies in lower silicon oil chamber 111. Thus ratchet assemblies 200 and 201 are surrounded by silicon oil, which additionally serves to lubricate the ratchet blocks, springs and other elements of the ratchet assemblies.

A spring 118 is provided in intermediate silicon oil chamber 109 and is trapped between an enlarged upper end 115 of pull mandrel 96 and a downward directed face 117 of an adapter portion 116 of power section housing 82. Thus, spring 118 biases pull mandrel 96, and the connected power mandrel assembly, in the downward direction.

Downward movement of follower mandrel 95 is limited by an upward directed face 120 on adapter portion 116 and downward directed face 121 on the power mandrel assembly formed in the upper end of follower mandrel 95. Cooperating splines 122 on adapter 116 and splines 123 on follower mandrel 95 are provided to prevent relative rotary movement between the inner power mandrel assembly and the outer housing assembly.

Fluid communication is provided between the upper silicon oil chamber 108 and the intermediate silicon oil chamber 109 through the power piston 93 by a pair of fluid passageways **128*a* and 128*b* in power piston 93. These passageways are separated by some convenient distance. In the preferred embodiment shown in FIG. 4*b*, the passageways are 180° apart to be opposite each other in the power piston 93**.

A groove 125 is provided circumferentially around the upper portion of the power piston 93, and a groove 126 is formed when the upper portion of follower mandrel 95 is threadably attached to the lower portion of power mandrel 92. This attachment is made by threaded connection 127 which traps the power piston 93 between a radially outwardly directed enlargement 170 on the power mandrel 92 and an enlargement 171 at the end of follower mandrel 95. The two flow passageways **128*a* and 128*b* extend from groove 125 to groove 126**.

In flow passage **128*a* is a check valve 129 which freely allows fluid to pass from the upper silicon oil chamber 108 to the intermediate silicon oil chamber 109 while checking or preventing fluid communication flowing from the intermediate silicon oil chamber 109 to the upper silicon oil chamber 108. In flow passage 128*b* is a metering device 130** such as the Lee Visco jet type device described earlier.

Silicon oil fluid flowing through the passages **128*a* and 128*b* through the check valve 129 or the visco jet 130 is filtered by filters 131 over groove 126 and filter 132 over groove 125** as shown.

As with the device illustrated in FIGS. **3*a* and 3*b*, the device disclosed in FIGS. 4*a*–4*d* compensates for increased pressures and temperatures of well annulus fluid as the apparatus is lowered into a well bore. This increased pressure is transmitted into power chamber 105 by port 83 and through floating piston 106 to the silicon oil trapped in the interconnecting silicon oil chambers 108, 109, 110 and 111. Gradual pressure changes may be transmitted from one side of power piston 93 to the other side by means of the metering device 130 in flow passageway 128*b***.

Increased annulus pressure, such as is required to operate the annulus pressure responsive tester valve at 25, will be transmitted to the silicon oil by floating piston 106 and will open the check valve 129 to transfer silicon oil from the upper oil chamber 108 to the intermediate oil chamber 109. A subsequent sudden decrease in annulus pressure, such as is used to close the tester valve 25, causes the check valve 129 in power piston 93 to close. The decreased annulus pressure will also cause a corresponding decrease in the pressure in power chamber 105 and the pressure of the silicon oil in upper silicon oil chamber 108. However, with the check valve 129 in the closed condition, the higher pressure will remain present in silicon oil chambers 109, 110 and 111. This higher pressure will be gradually decreased by the metering means 129 in flow passageway 128. If the annulus pressure is decreased faster than the metering device will allow silicon oil to transfer from chamber 109 to chamber 108, the power piston 93 will act as a hydraulic actuated piston to move the power mandrel assembly in the upward direction pulling operating mandrel 100 in the upward direction with the power mandrel assembly.

This movement of the operating mandrel 110 imparts power strokes to the connected circulation valve 202. It will be noted that power strokes of the power mandrel assembly compresses spring 118. If the annulus pressure is not changed over a period of time the metering device 129 permits fluid to be transferred from one side of piston 93 to the other side thus allowing the compressed spring 118 to move the power mandrel assembly downwardly to its initial position engaging faces 120 and 121.

The power apparatus of the device of FIGS. 4*a*–4*d* imparts an operating stroke to the attached circulating valve on pressure decreases, while the apparatus disclosed in FIGS. 3*a*–3*b* imparts an operating stroke to the attached circulating valve on pressure increases.

Figure 4A:
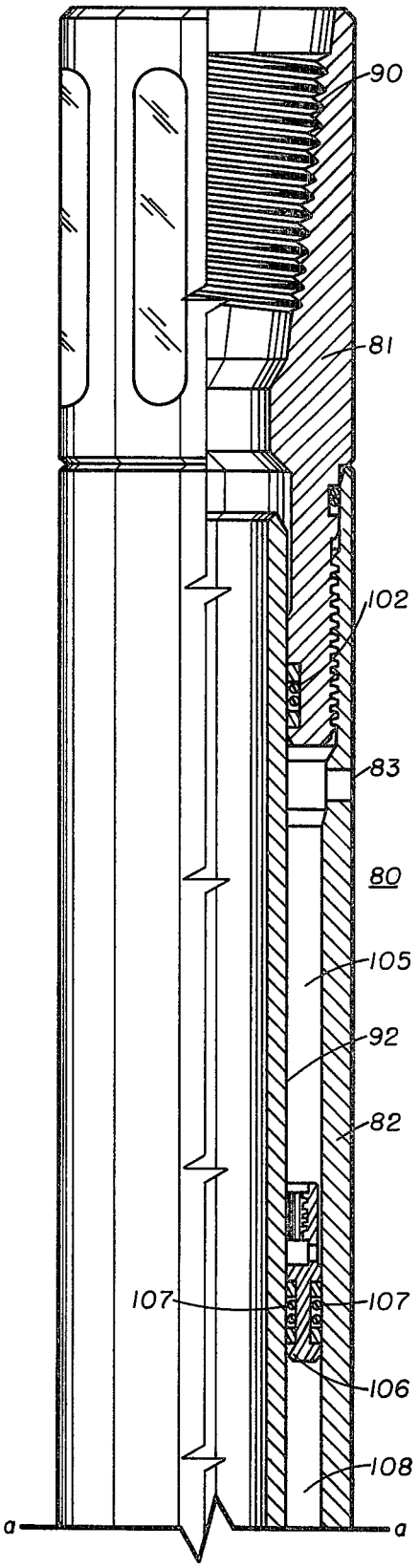
Figure 4B:
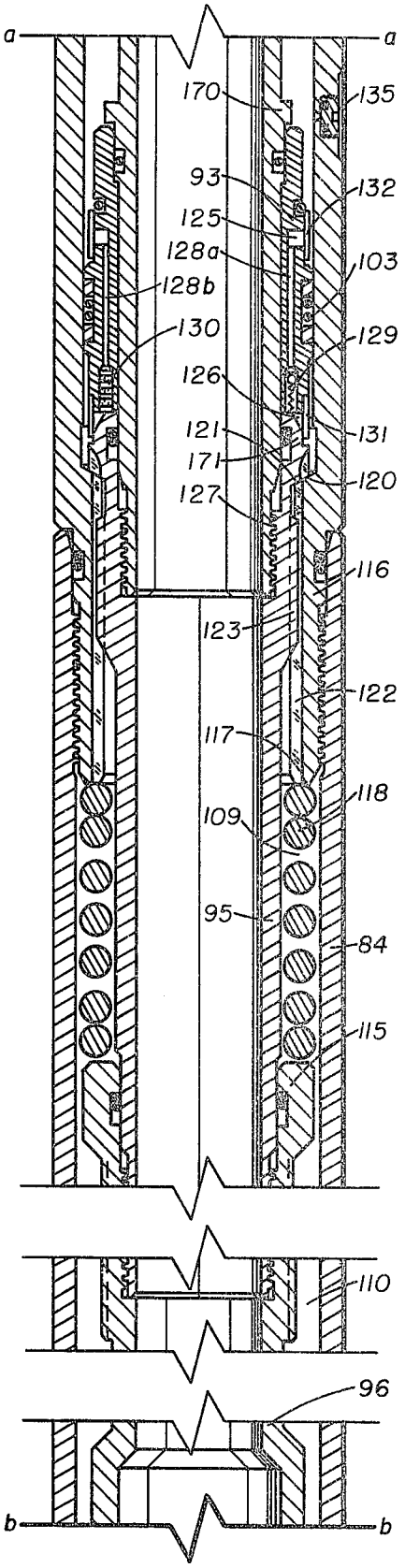
Figure 4C:
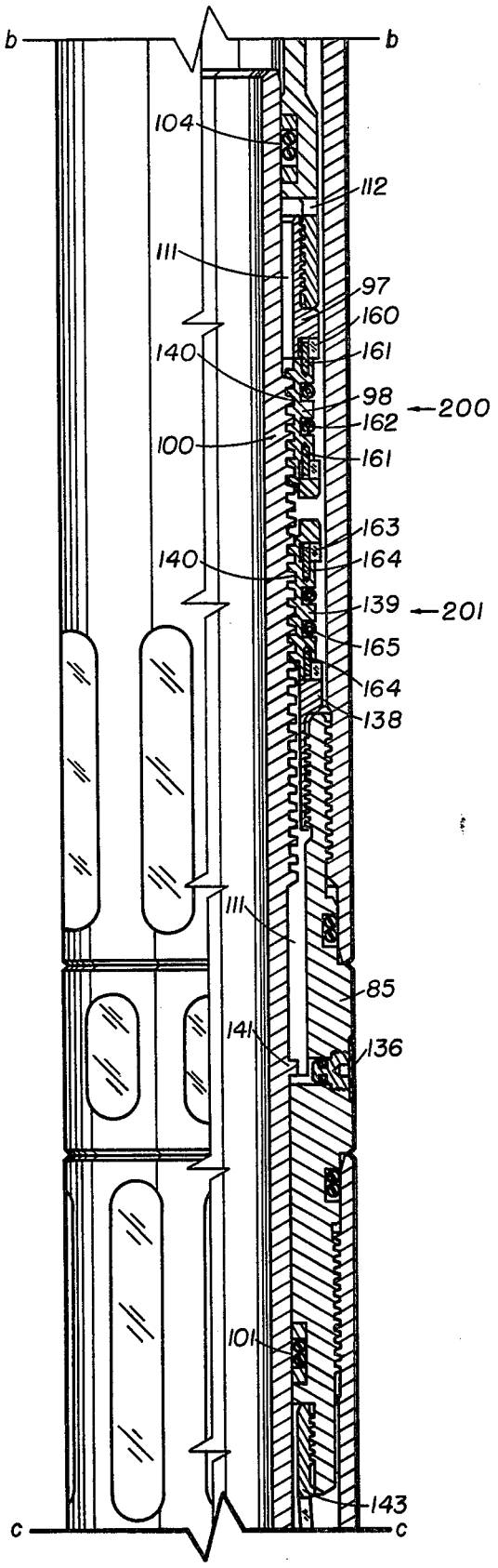

Filler plugs 135 and 136 are provided in the outer housing assembly to allow the interconnecting chambers 108, 109, 110 and 111 to be filled with silicon oil. A shoulder 141 is provided on the operating mandrel 100 to prevent mandrel 100 from moving too far in the downwardly direction as illustrated in FIG. 4*c*.

Figure 4D:
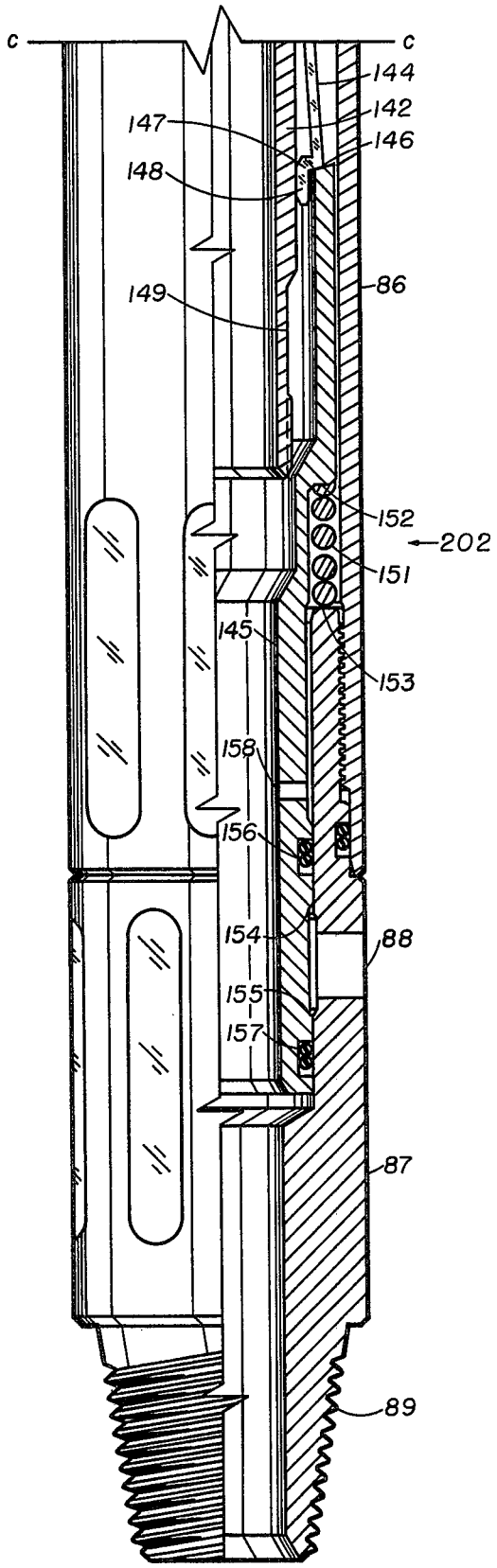

A circulation valve portion 202 of the apparatus is also disclosed in FIG. 4*d*. This apparatus includes the lower part 142 of the operating mandrel 100 which has a cutout portion 149.

The circulation valve portion 202 of the apparatus further includes a spring finger mandrel 143 connected to the outer housing assembly and having a plurality of spring fingers 144. Each spring finger 144 has a foot portion 148 and a downwardly directed face 147 of the spring finger. These fingers 144 have a radially inwardly directed bias such that the spring fingers 144 spring radially inwardly when released.

A circulation valve mandrel 145 extends downwardly from the foot portion 148 of the spring fingers 144, and sealingly cover the circulation port 88 as shown in FIG. 4*d*. The circulation valve mandrel is held in the downwardmost position by an upper face 146 which engages with the face 147 of the spring fingers 144. A valve opening spring 151 is provided between the circulation valve housing portion 87 and the circulation valve mandrel 145. When the circulation valve portion 202 is in the closed position, spring 151 is compressed between face 153 in the housing section 87 and the face 152 in the circulation valve mandrel 145 and urges the circulation valve mandrel 145 in the upward direction for opening the circulation port 88.

The circulation valve housing section 87 and the lower portion of circulation valve mandrel 145 are designed such that the upper face 155 of valve mandrel 145 exposed to the annulus pressure is smaller than the face 154 of the valve mandrel 145. This causes an upwardly directed force to be exerted on the valve mandrel 145 such that when the mandrel 145 is released the annulus pressure helps to open the valve mandrel 145.

The circulation port 88 is sealed from the interior bore 80 of the apparatus by appropriate seal means 156 and 157. A port 158 is additionally supplied in circulation valve mandrel 145 to prevent a hydrostatic lock when the circulation valve mandrel 145 is urged toward the open position. It can thus be seen that when sufficient cumulative power strokes are applied to the apparatus, the operating mandrel 100 moves in the upwardly direction until foot portions 148 of the spring fingers 144 drops into the cutout portion 145 of the lower section 142 of the operating mandrel 100. The natural radially inwardly directed bias of the spring fingers 144 assist in moving the spring fingers 144 in the inward direction releasing face 146 of the valve mandrel 145 from coengaging faces 147 of the spring fingers 144. Under the influence of spring 151 and the bias of the annulus pressure acting on larger face 154, the valve mandrel 145 is moved upwardly in the open direction to uncover circulation port 88.

It can thus be seen that an apparatus is disclosed in FIGS. 4*a*–4*d* which is completely pressure equalized as the apparatus is lowered into the well bore. Gradual increases in pressure due to increased annulus hydrostatic pressure from the increased well bore depth and from increased temperature of the annulus fluid will cause silicon oil to be transferred past piston 93 through metering means 130. A rapid increase in annulus pressure, such as may be provided by pump 15 on the floating work station 1, will cause the silicon oil to be transferred from the upper side of piston 93 to the lower side of piston 93 and to compress the silicon oil present in the interconnecting chambers 109, 110 and 111. A sudden decrease in annulus pressure, such as when the annulus pressure is released to close the tester valve 25, will close the check valve 129 and cause the piston 93 to move in the upward direction giving a power stroke to operating mandrel 100. During the period of time that the well formation 5 is shut-in, the power mandrel assembly will move in a downward direction under the influence of compressed spring 118 as silicon oil is metered by means 130 from the lower side to the upper side of power piston 93. Subsequent pressure increases and releases for operating the tester valve 25, will likewise incrementally move operating mandrel 100 in the upward direction until spring fingers 144 are released. By proper dimension of operating mandrel 100 and the volume of silicon oil in chambers 108, 109, 110 and 111, the number of incremental movements may be determined such that the pressure port 88 will not be uncovered to allow circulation of drilling fluid from the well annulus 16 to the interior 80 of the tool until after the testing program is complete.

The foregoing disclosure is intended to be illustrative only and is not intended to cover all embodiments that may occur to one skilled in the art to accomplish the foregoing objectives. Other embodiments which work equally well and are equivalent to the embodiments shown may be imagined by one skilled in the art. The attached claims are intended to cover the embodiments disclosed as well as such equivalent embodiments of the invention which may occur to one skilled in the art.

What is claimed is:

1. An oil well valve operating apparatus containing a volume of compressible liquid comprising:

a housing having a chamber in the walls thereof for containing said compressible liquid volume;

piston means dividing the liquid filled chamber and arranged to move responsive to a pressure differential across said piston means;

metering means through said piston means for relieving a pressure differential across said piston means at a metered rate;

spring means arranged to work in conjunction with said piston means for returning said piston means to a predetermined position as a pressure differential is metered through said piston means by said metering means;

pressure transmitting means for transmitting pressure to one end of said liquid chamber responsive to the well annulus pressure; and a power mandrel connected to said piston means for transmitting movement of said piston means to a valve which is activated by movement of said power mandrel responsive to a pressure change in the well annulus, which pressure change is imparted to the well annulus faster than the pressure change is relievable by said metering means.

2. The apparatus of claim 1 further comprising:

check valve means bypassing said metering means through said piston means for opening and allowing bypass flow through said check valve means when the pressure on a first side of said piston means is greater than the pressure on the second side of said piston means, and for closing and blocking bypass flow through said piston means when the pressure on the second side of said piston means is greater than the pressure on the first side of said piston means; and said power mandrel is arranged to move responsive to a higher pressure on the second side of said piston means when said second side pressure is increased faster than the pressure increase is relievable by said metering means.

3. The apparatus of claim 2 wherein said pressure transmitting means comprises a floating piston forming a movable wall of said chamber on the second side of said piston means for transmitting the well annulus pressure to said second side of said piston means; and said power mandrel moves responsive to an increase in well annulus pressure which pressure increase is faster than is relievable by said metering means.

4. The apparatus of claim 2 wherein said pressure transmitting means comprises a floating piston forming a movable wall of said chamber on the first side of said piston means for transmitting the well annulus pressure to said first side of said piston means; and said power mandrel moves responsive to a decrease in well annulus pressure, which pressure decrease is faster than is relievable by said metering means.

5. The apparatus of claim 2 further comprising limiting means for positioning said mandrel means in a predetermined location, said limiting means limiting the movement in one direction of said piston means responsive to said spring means.

6. An oil well valve operating apparatus containing a volume of compressible liquid responsive to changes in pressure in the annulus of the oil well comprising:

a tubular housing having a power port through the walls thereof;

a tubular power mandrel axially aligned with and slidably located in said housing and having an annular chamber between said power mandrel and said tubular housing for containing said volume of compressible liquid, said power mandrel being operatively connected to said oil well valve for moving said valve from a first position to a second position;

a floating piston in said annular chamber exposed on one side to well annulus pressure communicated to said one side by said power port, and exposed on a second side to the pressure of compressible liquid in said annular chamber;

positioning means between said power mandrel and said tubular housing for preventing said power mandrel from moving past a predetermined position in relation to said tubular housing when said power mandrel is moving in a first given direction with respect to said tubular housing;

power piston means on said power mandrel dividing said annular chamber and separated from said power port by said floating piston;

spring means between a portion of said tubular housing and a portion of said power mandrel to return said power mandrel to said predetermined position after said power mandrel has moved in a direction opposite from said first direction due to changes in the pressure in said well annulus, said pressure changes being transmitted to said power piston through said power port, said floating piston and a portion of the compressible liquid between said floating piston and said power piston; and liquid metering means for passing the compressible liquid from one side of said power piston to the other side of said power piston for balancing in a predetermined relatively slow manner any pressure imbalance between portions of said divided annular chamber.

7. The apparatus of claim 6 further comprising:

check valve means bypassing said liquid metering means for opening and allowing bypass flow from one side of said power piston to the other side of said power piston in a predetermined direction, and for closing and preventing said bypass flow in the opposite direction to provide for movement of said power mandrel under the influence of a pressure differential across said power piston means when said check valve means is closed.

8. A method of operating a valve in an oil well comprising:

providing a volume of compressible liquid in a chamber in an oil well apparatus;

dividing the compressible oil chamber with a piston having a metering means therethrough;

urging the piston in a first longitudinal direction to an initial position with a spring means;

transmitting pressure exterior of the apparatus to one side of the piston;

lowering the apparatus into the oil well to a predetermined depth;

metering changes in pressure and volume of the compressible oil through said metering means from one side of the piston to the other side;

changing the pressure in the well bore exterior of the apparatus at a rate faster than relievable by said metering means;

moving the piston in a second longitudinal direction against said spring means responsive to the pressure differential across said piston;

metering compressible oil through said metering means and moving said piston by said spring means in the first longitudinal direction back to its initial position; and responsive to said motions of said piston, activating a valve in said oil well.

* * * * *